US009348315B2

(12) United States Patent
Cattaneo et al.

(10) Patent No.: US 9,348,315 B2
(45) Date of Patent: May 24, 2016

(54) WATCH CASE ROTATING BEZEL

(71) Applicant: ROLEX SA, Geneva (CH)

(72) Inventors: Julien Cattaneo, Esery (FR); Arnaud Rosenzweig, Saint-Juliene-en-Genevois (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/617,561

(22) Filed: Feb. 9, 2015

(65) Prior Publication Data

US 2015/0227113 A1 Aug. 13, 2015

(30) Foreign Application Priority Data

Feb. 10, 2014 (EP) ..... 14154485

(51) Int. Cl.
*G04B 19/22* (2006.01)
*G04B 19/28* (2006.01)

(52) U.S. Cl.
CPC ..... *G04B 19/223* (2013.01); *G04B 19/283* (2013.01)

(58) Field of Classification Search
CPC .... G04B 19/28; G04B 19/238; G04B 29/286; G04B 19/223
See application file for complete search history.

(56) References Cited

U.S. PATENT DOCUMENTS 3,512,353 A * 5/1970 Blum ..... G04B 19/28 368/295
3,520,129 A * 7/1970 Schneider ..... G04B 19/28 368/295
5,319,617 A * 6/1994 Sonoda ..... G04B 19/283 368/294
5,490,123 A * 2/1996 Biver ..... G04B 47/046 368/294
5,541,895 A * 7/1996 Nussbaum ..... G04B 19/283 368/295
6,010,241 A * 1/2000 Bulgari ..... G04B 3/08 368/187
6,200,019 B1 * 3/2001 Latini ..... G04B 19/283 368/288
6,599,009 B2 * 7/2003 Terasawa ..... G04B 19/283 368/294
7,434,984 B2 10/2008 Hiranuma et al.
7,490,978 B2 * 2/2009 Crisci ..... G04B 19/283 368/294
7,572,049 B2 8/2009 Hiranuma
2003/0123332 A1 7/2003 Hiranuma et al.
2004/0141424 A1 7/2004 Hartmann et al.
2006/0285443 A1 12/2006 Vogt et al.
2007/0091727 A1 4/2007 Bonvin et al.
2008/0279053 A1 * 11/2008 Robert-Nicoud ..... G04B 45/00 368/295
2009/0010109 A1 1/2009 Graemiger et al.
2011/0242947 A1 10/2011 Graemiger et al.

FOREIGN PATENT DOCUMENTS

CH 308601 A 7/1955
CH 706 597 A2 12/2013

(Continued)

OTHER PUBLICATIONS

European Search Report dated Nov. 4, 2014, issued in corresponding application EP14154485, and Written Opinion; with partial English translation and partial machine-translation (13 pages).

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

Rotary bezel device (11L) for a timepiece (110), the device comprising a first rotary ring (B1), a second rotary ring (B2) and a first mechanical-connection element (C1) allowing the first rotary ring and the second rotary ring to be kinematically connected.

25 Claims, 15 Drawing Sheets

(56) References Cited

FOREIGN PATENT DOCUMENTS

| | | | |
|---|---|---|---|
| EP | 1 431 845 | A1 | 6/2004 |
| EP | 1 777 598 | A1 | 4/2007 |
| EP | 2 012 199 | A2 | 1/2009 |
| WO | 97/39386 | A1 | 10/1997 |
| WO | 2004/053599 | A2 | 6/2004 |

* cited by examiner

WATCH CASE ROTATING BEZEL

The invention relates to a rotating or rotary bezel device of a watch case or for a watch case. The invention also relates to a watch case comprising such a device. The invention further relates to a timepiece, notably a watch, comprising such a watch case or such a device.

Document CH308601 describes a watch case provided with two concentric bezels which are graduated for two time scales, so as to allow two separate time indications such as the hours and the minutes to be displayed. This solution has the disadvantage of having a very strong esthetic impact on the watch case.

Documents U.S. Pat. No. 7,434,984 and U.S. Pat. No. 7,572,049 describe solutions that allow the one-way or two-way rotation of a bezel devoted to displaying time information to be activated on demand. More particularly, these solutions relate to locking devices designed to prevent unwanted rotation of the bezel as this would carry the risk of distorting the time information indicated. There is no case in which these solutions would allow the bezel to perform an additional function.

Other documents disclose rotating bezels which act as control or adjusting members or even as selection members. Patent application EP1777598 describes a bezel which is designed to lock the axial position of an auxiliary control member. Patent application WO2004053599 relates to a bezel capable of setting time information, notably the timezones of a timepiece. Patent application EP2012199 for its part discloses a bezel that acts as a selector for correction functions. By their very construction, these bezels are unable to perform an additional function.

Patent application WO9739386 discloses a dual-function bezel one or the other of the functions of which is activated according to the axial position of a selection member. The first function is a function of rewinding the movement, and the second function is a function of setting the time. The switchover between the two functions is made possible by the mechanism of the basic movement which is entirely conventional. Thus, the bezel is in constant mesh with a geartrain of the basic movement. One disadvantage with this solution lies in the fact that it cannot be disengaged from the basic movement so that it can be turned unrestricted, if for example it were to carry time information or information derived from the time.

In the light of the prior art, it has been found that a watch case bezel may perform various functions. It may either act as a display member or constitute an adjusting, control or selection member. It may also constitute a member for controlling two timepiece functions under activation of a clutch device internal to the timepiece movement. The bezel may potentially be accompanied by a device auxiliary to the case allowing rotation thereof to be activated or not.

It is an object of the invention to provide a device that makes it possible to overcome the disadvantages mentioned hereinabove and improve the rotating bezels known from the prior art. In particular, the invention proposes a rotating bezel device that allows several functions to be performed, i.e. that is able in addition notably to perform a function of indicating time information or information derived from the time, is able to perform an adjusting function or a function of selecting a time mechanism included within a timepiece movement.

According to one aspect of the invention, a rotary bezel device for a timepiece comprises a first rotary ring, a second rotary ring and a first mechanical-connection element allowing the first rotary ring and the second rotary ring to be kinematically connected, the first mechanical-connection element having a first configuration, notably a first position, that allows the rotational movements of the first rotary ring and second rotary ring to be left independent of one another, and a second configuration, notably a second position, allowing the first rotary ring and the second rotary ring to be kinematically connected.

Various aspects of the rotary bezel device are as follows:

The first mechanical-connection element is arranged in such a way as to secure the first rotary ring and the second rotary ring together, notably to secure the first rotary ring and the second rotary ring together with lesser play.

The first rotary ring comprises marks or indexes, notably marks or indexes for indicating time or indicating a derivative of the time, notably marks or indexes for indicating time or for indicating a derivative of the time which are intended to collaborate with at least one member for indicating the time or for indicating a derivative of the time.

The first rotary ring is arranged in such a way as to axially and/or radially cover and/or hide the second rotary ring.

The second rotary ring comprises a second mechanical-connection element allowing the second rotary ring to be connected kinematically to a mechanism of a timepiece movement, notably to a correction or selection mechanism.

The device comprises a first notching element allowing to carry out a notching between the first and second rotary rings.

The device comprises a spring, notably a trigonal spring, mounted on the first rotary ring, respectively on the second rotary ring, and collaborating by contact with a shaping, notably lobes, produced on the second rotary ring, or respectively on the first rotary ring.

The second rotary ring comprises a second notching element allowing to carry out a notching between the second rotary ring and a watch case middle or a watch case.

The first mechanical-connection element comprises a cam, notably a lever, mounted to rotate on the second rotary ring and designed to collaborate as an obstacle with a shaping, notably a cutout, made in a watch case middle.

The first mechanical-connection element comprises a washer provided with cutouts and/or the first notching element.

The first mechanical-connection element comprises at least one intermediate wheel able to engage with at least one of the first and second rotary rings.

According to one aspect of the invention, a watch case comprises a rotary bezel device as above.

Various aspects of the watch case are as follows:

A watch case comprises a rotary bezel device as above and a case middle, the case being a case wherein the first mechanical-connection element comprises a cam, notably a lever, mounted to rotate on the second rotary ring, respectively on the case middle, and designed to collaborate as an obstacle with a shaping, notably a cutout, made in the case middle, respectively, on the second rotary ring.

A watch case comprises a rotary bezel device as above and a case middle, the case being a case wherein the first mechanical-connection element comprises a cam, notably a shuttle, mounted for translational movement relative to the case middle and designed to collaborate as an obstacle with a shaping. notably a cutout. made on the second rotary ring.

A watch case comprises a rotary bezel device as above and a case middle, the case being a case wherein the first mechanical-connection element comprises a washer provided with cutouts.

A watch case comprises a third mechanical-connection element that allows the second rotary ring and the case middle to be secured together. notably to be secured together with lesser play.

A watch case comprises a fourth mechanical-connection element that allows an auxiliary ring and the case middle to be secured together, notably to be secured together with lesser play.

The third mechanical-connection element comprises a cam, notably a shuffle, mounted for translational movement relative to the case middle and designed to collaborate as an obstacle with a shaping, notably a cutout, made on the second rotary ring.

A watch case comprises a control member, notably a crown, and wherein the first mechanical-connection element and/or the third mechanical-connection element and/or the fourth mechanical-connection element is designed to collaborate with the control member, the configuration, notably the position, of the control member determining the configuration. notably the position, of the first mechanical-connection element and/or of the third mechanical-connection element and/or of the fourth mechanical connection element.

According to one aspect of the invention, a timepiece comprises a rotary bezel device as above.

The attached drawings depict, by way of examples, several embodiments and alternative forms of embodiment of a rotating bezel according to the invention and of timepieces comprising such a rotating bezel.

Figure 1:
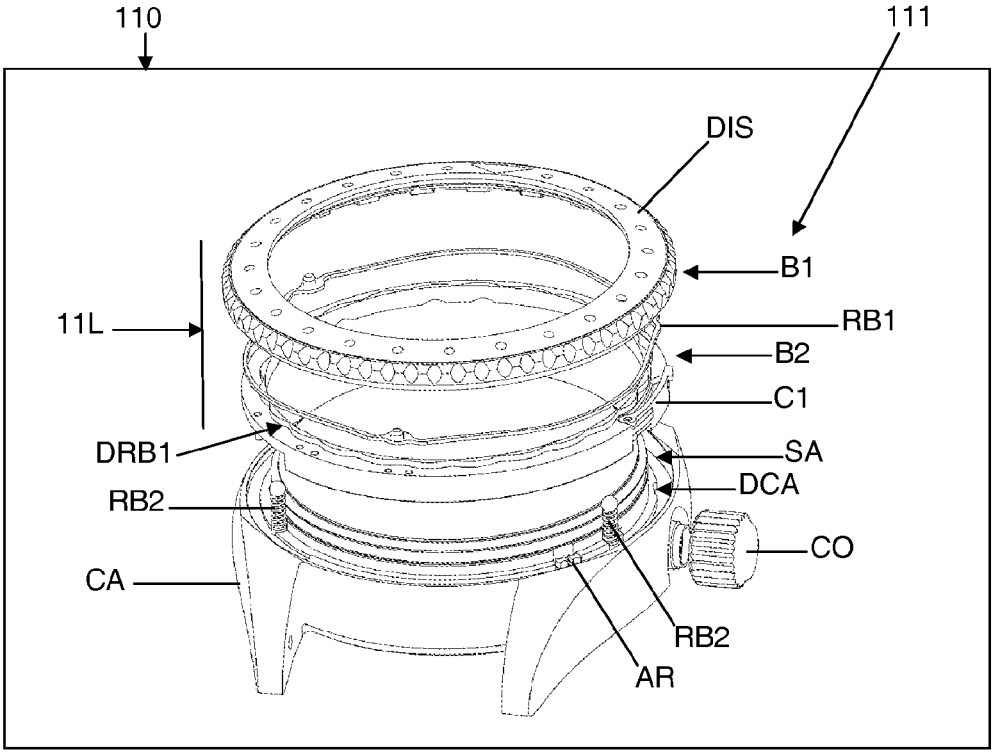
FIGS. 1 to 10 are views of a first alternative form of a first embodiment of a rotating bezel according to the invention.

According to the invention, a watch case rotating bezel is capable of performing two separate functions under actuation of an auxiliary control member. These functions may for example be functions of display, adjustment, rewinding or even of selection. Such a bezel makes it possible to multiply the displays and/or the means of adjustment of a wristwatch while at the same time minimizing the esthetic impact on the watch case. For preference, the bezel control member may be a crown of the timepiece so that the incorporation of the device is not visible to the wearer of the watch.

Such a bezel allows activation of one or the other of two functions that said bezel is capable of performing under the effect of a clutch device external to the timepiece movement.

The invention is illustrated by various constructions within which a watch bezel, designed to display and adjust a first time indication, is, for example, capable of selecting correction functions or of adjusting a second piece of time information, which may or may not be derived from the first piece of time information, according to the axial position of the crown of the timepiece.

A first alternative form of a first embodiment of a timepiece 110 according to the invention is described hereinafter with reference to FIGS. 1 to 10. The timepiece is notably a watch, particularly a wristwatch. The timepiece comprises a watch case 111 containing a watch movement 113 which includes one or more timepiece mechanisms 112.

The watch case comprises a case middle CA, a case back FD, a crystal GL and a rotating bezel device 11L.

The rotating bezel or rotary bezel device 11L comprises a first rotary ring B1, a second rotary ring B2 and a first mechanical-connection element C1 allowing the first rotary ring and the second rotary ring to be kinematically connected.

Thus, at least two annular rings B1, B2 are capable of being connected and disconnected to and from one another in terms of rotation under the action of a control member CO. This control member CO actuates the bezel 11L via a first mechanical element or cam C1 external to the timepiece movement. What we mean by cam is any mechanical element capable of blocking or of allowing the movement of a component that is able to be moved. In the first embodiment, this cam C1 may take the form of a lever or of a shuttle. What we mean by lever is any mechanical element provided with at least one arm, which can be moved in rotation. What we mean by shuttle is any cam capable of translational movement.

Advantageously, the first rotary ring is arranged in such a way as to axially and/or radially cover and/or hide the second rotary ring.

In the first embodiment, the rings B1 and B2 are secured together in terms of rotation by direct or indirect actuation of the first cam C1. In all the alternative forms of embodiment and all the embodiments described, the bezel control member CO is a crown of the timepiece. However, this member could be of another kind or structure such as a push-button or an auxiliary bezel.

In the first alternative form of the first embodiment as depicted in FIG. 1, the first cam C1 may be able to move in terms of rotation relative to the case middle CA according to the axial position of the crown CO. This first cam C1 is mounted on the ring B2 the angular spacing of which is defined by cutouts DRB2 designed to collaborate with spring-loaded balls RB2 which are arranged on an annular seat SA of the case middle as depicted in FIG. 7. This first cam C1 here takes the form of a lever pivoted about a pin PC1 as depicted in FIGS. 3 and 6.

Figure 2:
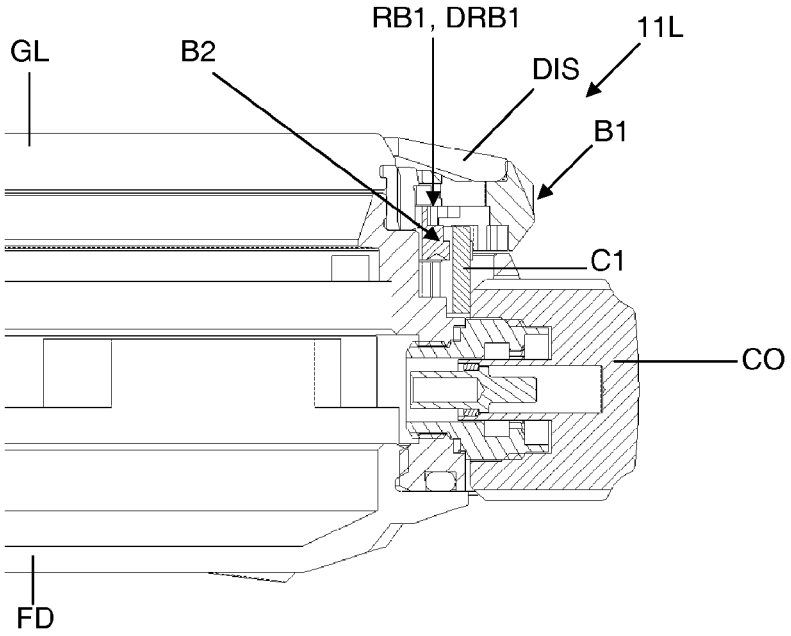
Figure 3:
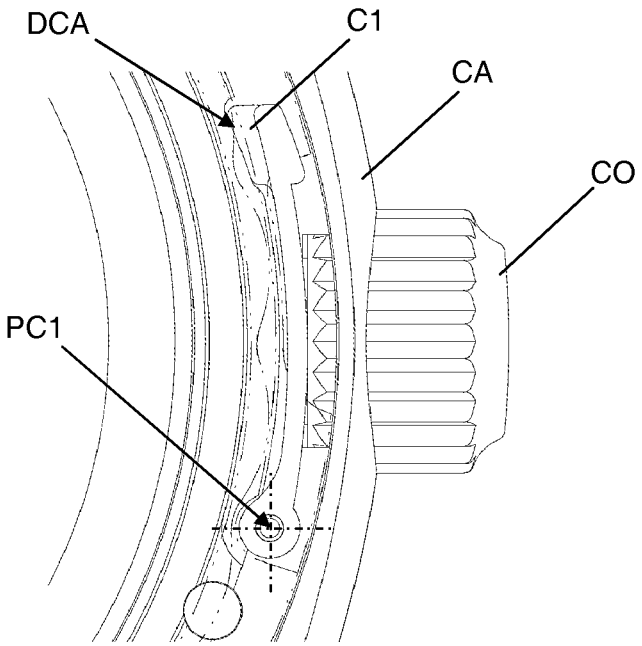

When the crown CO is screwed down as in the configurations of FIGS. 2 and 3, it confines a first end of the cam C1 to a cutout DCA formed within the case middle so as to secure the ring B2 to the case middle CA with lesser play, thereby preventing, by providing an obstacle, the ring B2 from rotating relative to the case middle. In this configuration, the ring B1 secured to a time indicating disk DIS, can then turn relative to the ring B2 when the latter is actuated by the wearer of the watch. Thus, the first rotary ring B1 may comprise marks or indexes indicating time or indicating a derivative of the time, notably marks or indexes indicating time or indicating a derivative of the time which are intended to collaborate with at least one member for indicating time or indicating a derivative of the time, such as a hand.

Figure 4:
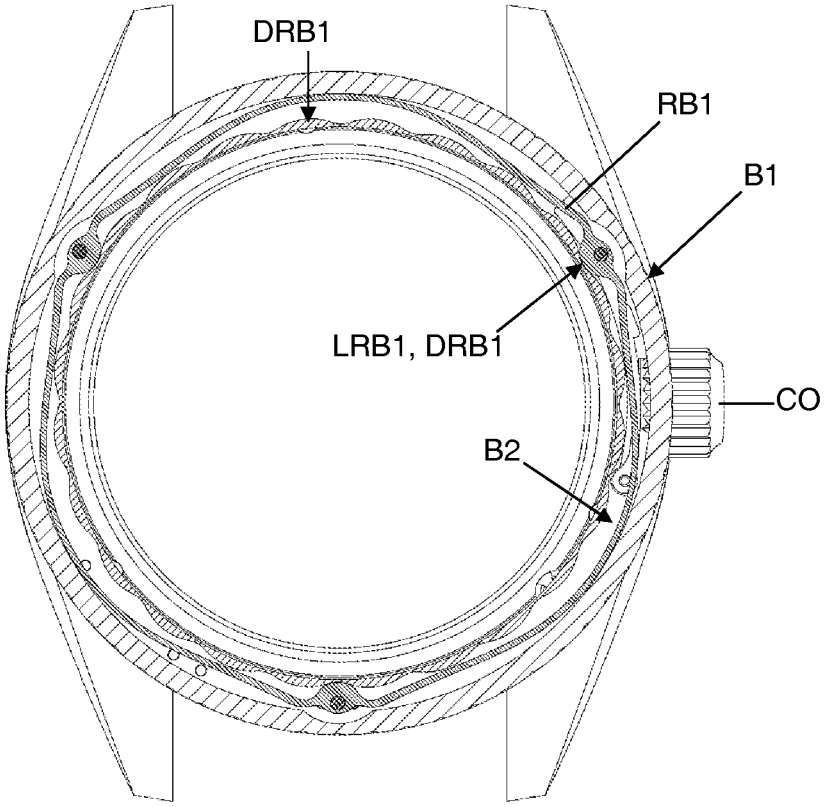
Figure 5:
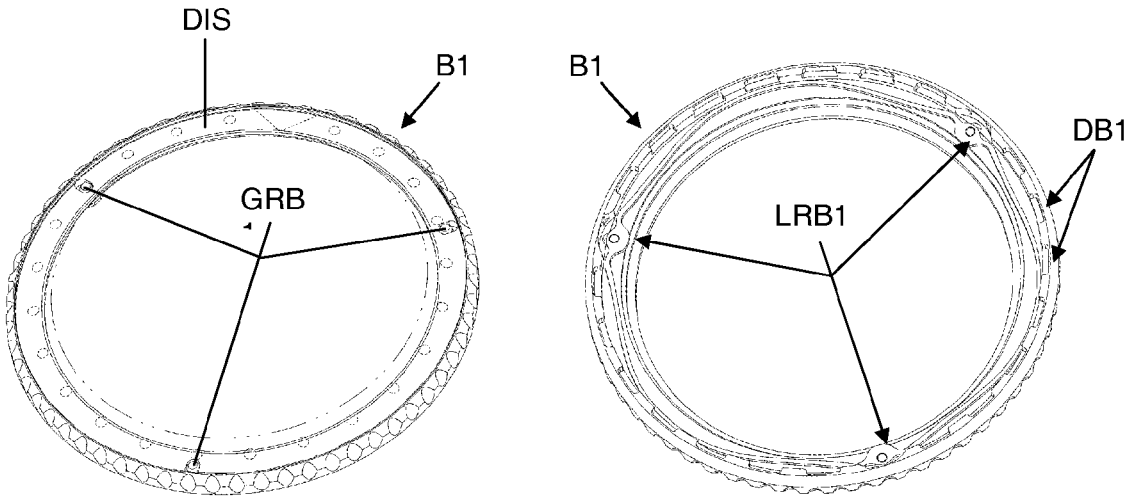

The bezel device comprises a first notching element that allows to carry out a notching between the first and second rotary rings. The first notching element may comprise a spring RB1, for example a trigonal spring RB1, and a toothset DRB1 formed for example on a bearing surface of one of the rings. The trigonal spring may be mounted on the first rotary ring or, respectively, on the second rotary ring, and collaborate by contact with a shaping, notably lobes, made on the second rotary ring or, respectively, on the first rotary ring. The angular spacing of the ring B1 is defined by the notching element, notably by the spring RB1 which rotates as one with the ring B1 through the interposition of pegs GRB1 as depicted in FIGS. 4 and 5. The spring may be a trigonal spring of which the lobes LRB1 are intended to collaborate with the toothset DRB1 which may be formed on a bearing surface of the ring B2 as illustrated in FIG. 4. Thus, when the crown CO is screwed down, the first ring B1 has n notches defined by the spring RB1 and the toothset DRB1 relative to the second ring B2. By way of example, the toothset DRB1 is made up here of n=24 teeth or lobes so as to indicate and adjust a time which is displayed on a 24-hour graduation affixed to the disk DIS of the bezel 11L as illustrated in FIGS. 1 and 5.

Figure 6:
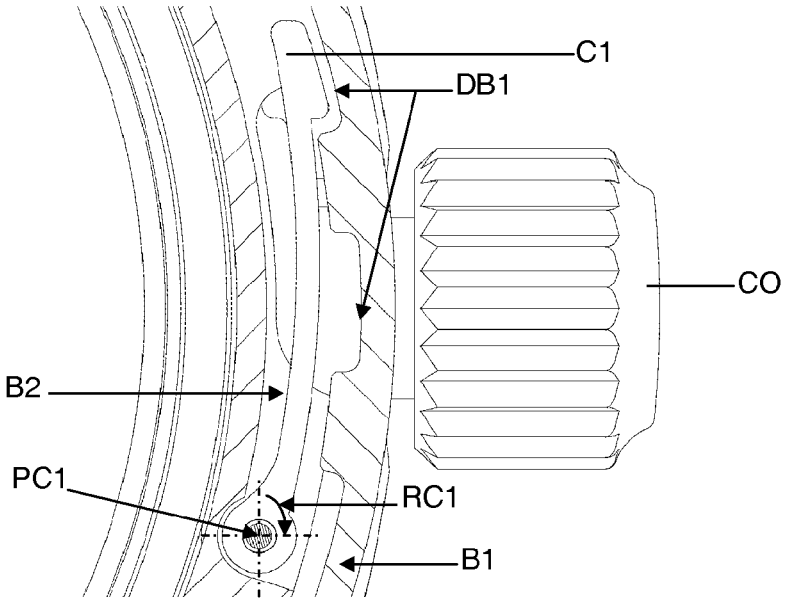
Figure 7:
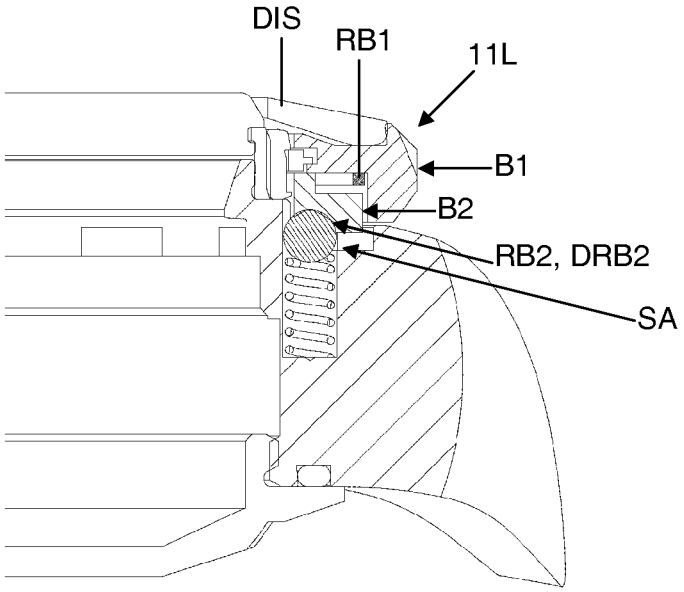

When the crown CO is unscrewed, as in FIG. 6, a second end of the cam C1, actuated under the effect of a return spring RC1 depicted schematically in FIG. 6, becomes lodged in one of the m cutouts DB1 formed at the periphery of the ring B1, thus securing the rings B1 and B2 together in terms of rotation. For preference, m is equal to n. The notching performed by the spring RB1 is thus canceled and gives way to the notching defined by the spring-loaded balls RB2 and the cutouts DRB2 of the ring B2 as depicted in FIG. 7. Thus, the bezel device and, more generally, the watch case incorporating the bezel device, comprises a second notching element that allows to carry out a notching between the second rotary ring B2 and the case middle CA. The second notching may comprise one or more spring-loaded balls RB2 designed to become lodged in one of the M cutouts DRB2 formed for example on the seat of the ring B2.

Thus, when the crown CO is unscrewed, a notching between the bezel 11L and the case middle has N notches defined by the springs RB2 and the M cutouts DRB2. N may be equal to n. Alternatively, N may differ from n.

Figure 8:
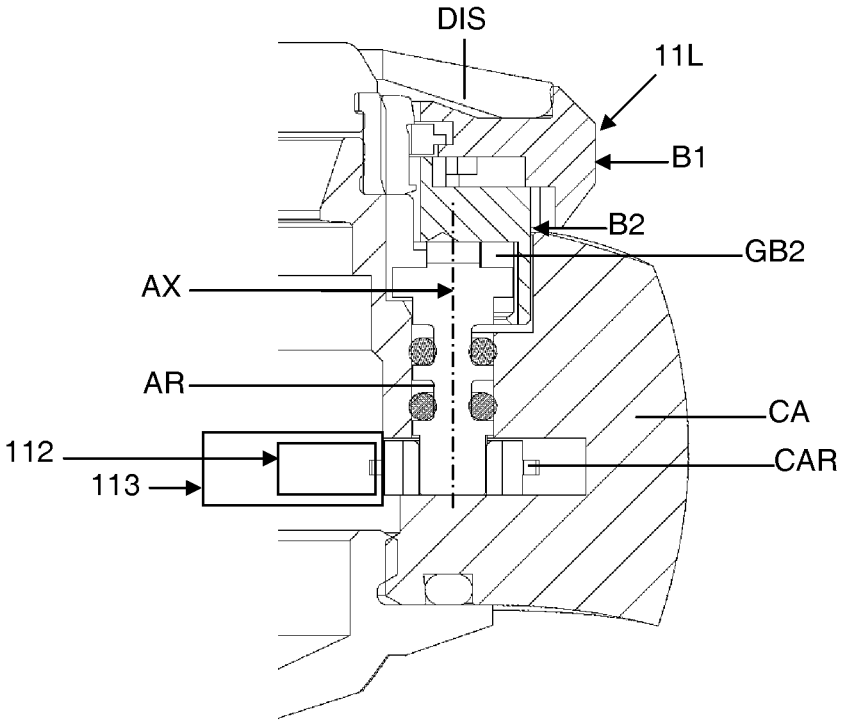
Figure 9:
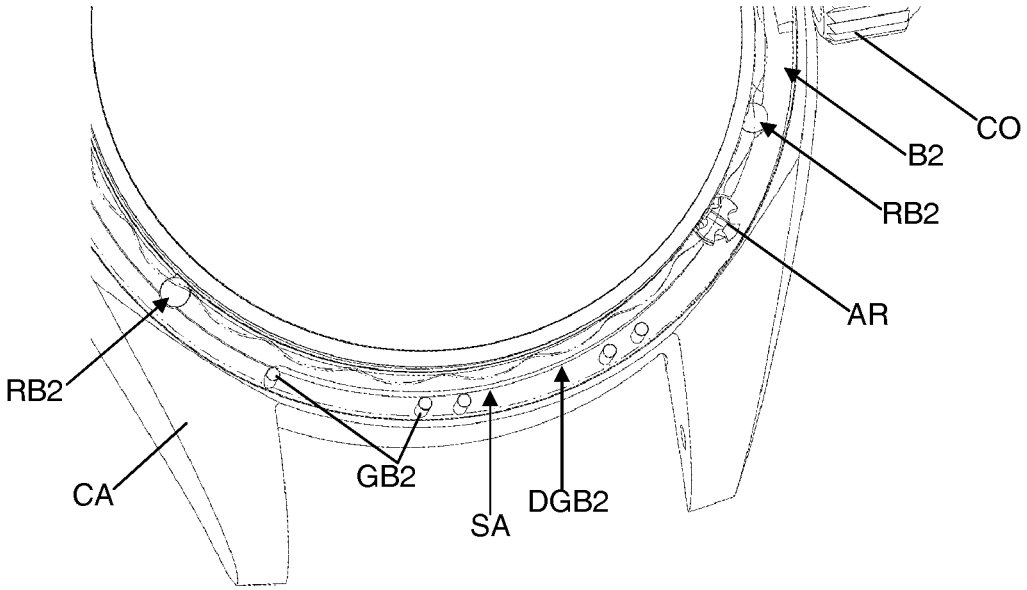
Figure 10:
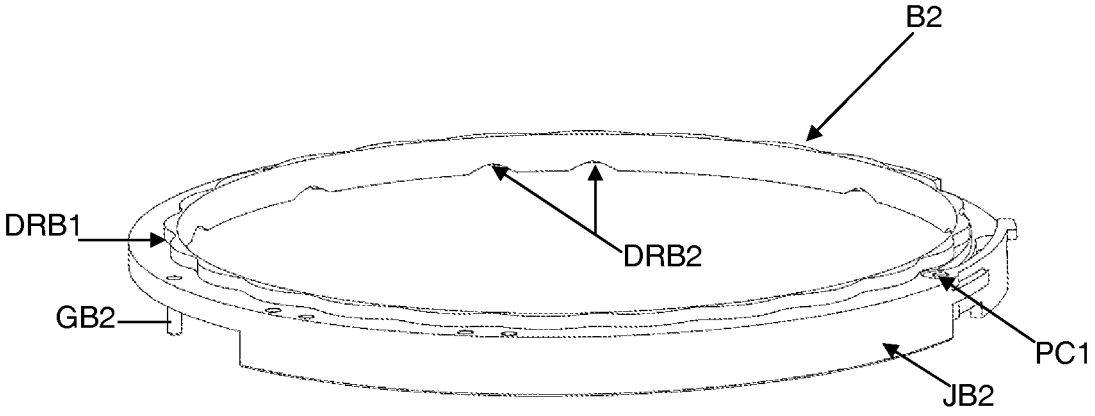

For preference, the second rotary ring B2 comprises a second mechanical-connection element GB2 allowing the second rotary ring to be kinematically connected to a mechanism 112 of the timepiece movement 113, notably to a correction or selection mechanism. Advantageously, the second connection element comprises pins GB2 which can come into mesh with a shaft AR pivoted in the case middle CA about an axis AX, as illustrated in FIGS. 8 and 9. This shaft AR, via its cam CAR, can actuate the mechanism 112 of the timepiece movement 113.

The mechanism may comprise a cam for selecting a mechanism of the movement or else a runner for correcting a time indication or an indication derived from the time. Thus, when the crown CO is unscrewed, the bezel 11L may for example constitute a selection member or an adjusting member for a time indication or an indication derived from the time. Specifically, in this configuration, an action performed by the user on the bezel causes the first and second rings to rotate relative to the case middle and therefore causes the shaft AR to rotate and the mechanism 112 to be activated.

Advantageously, the angular arc through which the bezel 11L travels is in this instance strictly smaller than 360°, or even smaller than 180° when the crown CO is unscrewed. This angular range is defined by the pins GB2 of the ring B2 and by the ends of a cutout DGB2 formed on the annular seat SA of the case middle CA as illustrated in FIG. 9.

The second mechanical-connection element that allows the second rotary ring to be kinematically connected to the mechanism 112 of the timepiece movement 113 may have a different structure. It may for example be an engagement toothset intended to collaborate with a complementary toothset provided on the shaft AR.

For preference, an annular skirt JB2 is formed on the ring B2 so that the crown CO cannot be screwed back down unless the ring B2, the ring B1 and the disk DIS bearing the latter have been previously returned to the angular position they occupied before the ring B2 was turned. This construction also allows the cam C1 to be repositioned facing the crown CO so that the screwing back down of this crown secures the cam C1 to the case middle CA and indexes and thus blocks the ring B2 in position relative to the case middle.

Thus, in this first alternative form of the first embodiment, the first mechanical-connection element has a first configuration, notably a first position illustrated in FIG. 3, that allows the rotational movements of the first rotary ring B1 and second rotary ring B2 relative to one another to be left independent and a second configuration, notably a second position illustrated in FIG. 6, that allows the first rotary ring B1 and the second rotary ring B2 to be kinematically connected. The first mechanical-connection element is, in its second configuration, notably in its second position, able to secure the first rotary ring and the second rotary ring together with lesser play, i.e. to immobilize the first and second rings relative to one another.

In this first alternative form, the watch case therefore comprises a control member CO, notably the crown, designed to collaborate with the first mechanical-connection element, the configuration, notably the position, of the control member determining the configuration, notably the position, of the first connection element.

It will be noted that in this alternative form of the first embodiment, the bezel device comprises a third mechanical-connection element having a first configuration, notably a first position illustrated in FIG. 3, allowing the case middle and the second rotary ring B2 to be kinematically connected and a second configuration, notably a second position illustrated in FIG. 6, allowing the rotational movement of the second rotary ring B2 relative to the case middle to be left free. The third mechanical-connection element is, in its first configuration, notably in its first position, able to connect the case middle and the second rotary ring together with lesser play, i.e. to immobilize the second ring on the case middle. The third mechanical-connection element is, in its second configuration, notably in its second position, able to secure the first and second rotary rings together with lesser play. The third mechanical-connection element like the first mechanical-connection element comprises the cam C1, particularly the lever C1.

Unless otherwise indicated, in the other alternative forms and/or the other embodiment, a second element denoted by a reference that is the same as a reference used in the first alternative form to denote a first element performs the same function and/or has the same structure as this first element.

The elements distinguishing the other alternative forms and variants of the first embodiment are indicated further on.

A second alternative form of the first embodiment of a timepiece 120 according to the invention is described hereinafter with reference to FIGS. 11 to 17. The timepiece is notably a watch, particularly a wristwatch. The timepiece comprises a watch case 121 containing a timepiece movement including one or more timepiece mechanisms.

The watch case comprises a case middle CA, a case back FD, a crystal GL and a rotating bezel device 12L.

The rotating bezel or rotary bezel device 12L comprises a first rotary ring B1, a second rotary ring B2 and a first mechanical-connection element C1, RB1, DGRB1, GRB1, LRB1, DRB1, C2, DC2 allowing the first rotary ring and the second rotary ring to be kinematically connected.

In the second alternative form of the first embodiment, a cam C1 and a spring RC1 are arranged in the case middle CA and are mounted coaxially with respect to a crown CO. The cam C1 is a shuttle capable of translational movement relative to the case middle under the effect of the spring RC1 and of the crown CO. This cam is angularly indexed by a cutout DCA made in the case middle CA which is designed to accommodate a projection S11 of the cam C1 as illustrated in FIG. 12.

Figure 12:
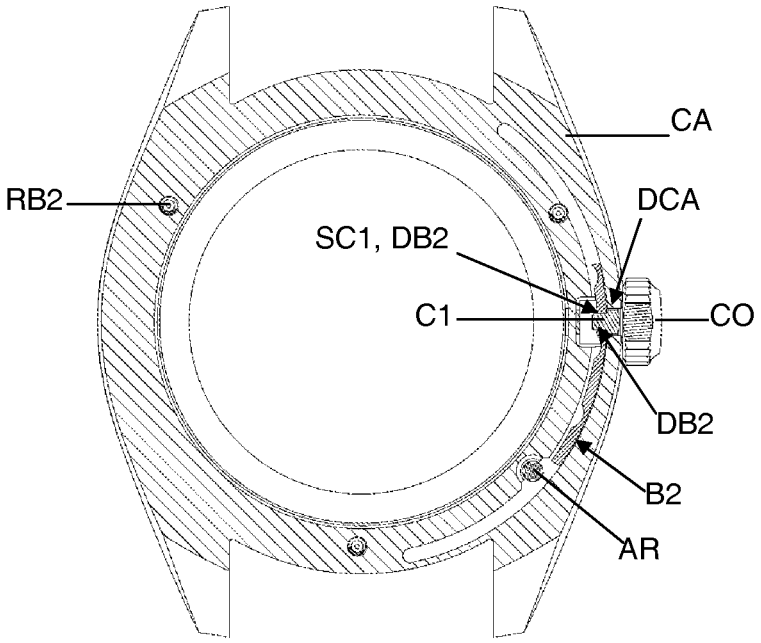
Figure 13:
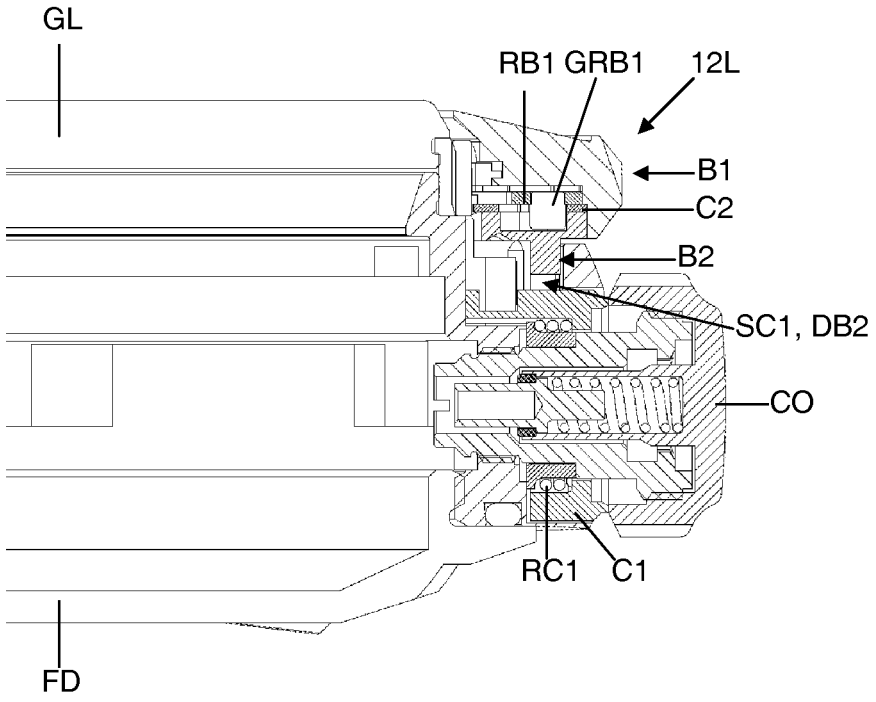
Figure 14:
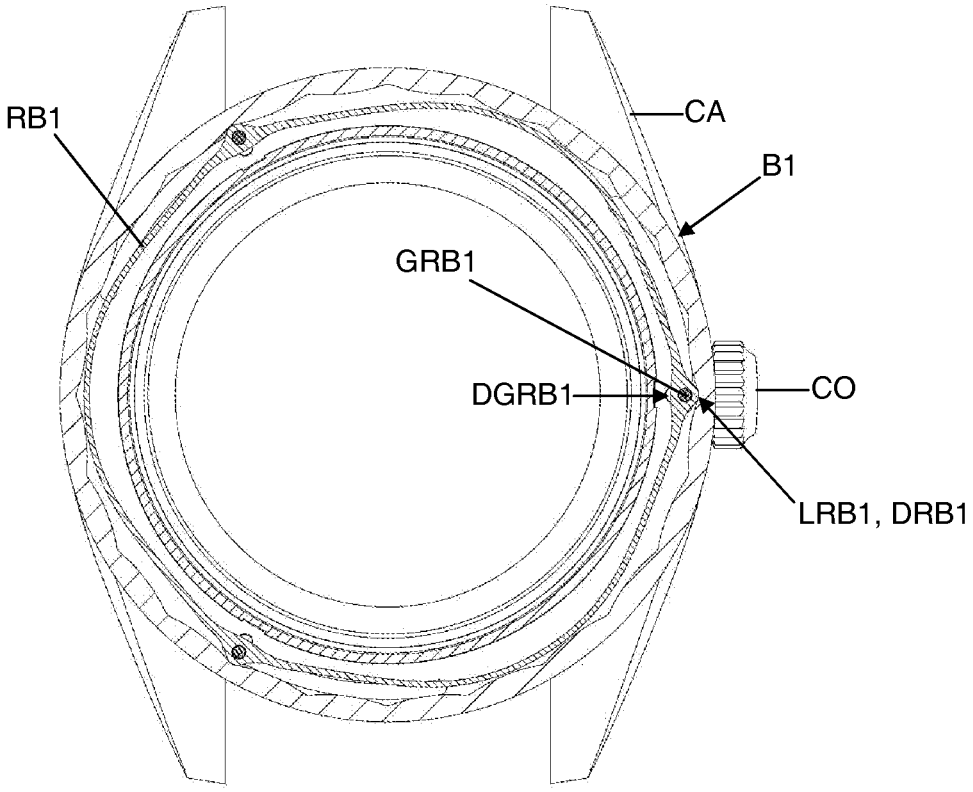

When the crown CO is screwed down, as depicted in FIGS. 12 to 14, the ring B2 is blocked in terms of rotation under the effect of the cam C1 a projection SC1 of which is housed in a cutout DB2 made in an annular skirt JB2 of the ring B2.

In this second alternative form, the rotating bezel device comprises a first notching element allowing carrying out a notching between the first and second rings. The first notching element comprises a spring, notably a trigonal spring RB1, mounted on the ring B2 via the interposition of pins GRB1. Lobes LRB1 of the spring are provided to collaborate with an internal toothset DRB1 which is formed at the periphery of the ring B1 as illustrated in FIG. 14. Thus, when the crown CO is screwed down, the pins GRB1 of the trigonal spring are capable of moving in oblong cutouts DGRB1 formed at the surface of the ring B2 and thus allow the ring B1 to rotate and the notching over n notches relative to the ring B2.

Figure 15:
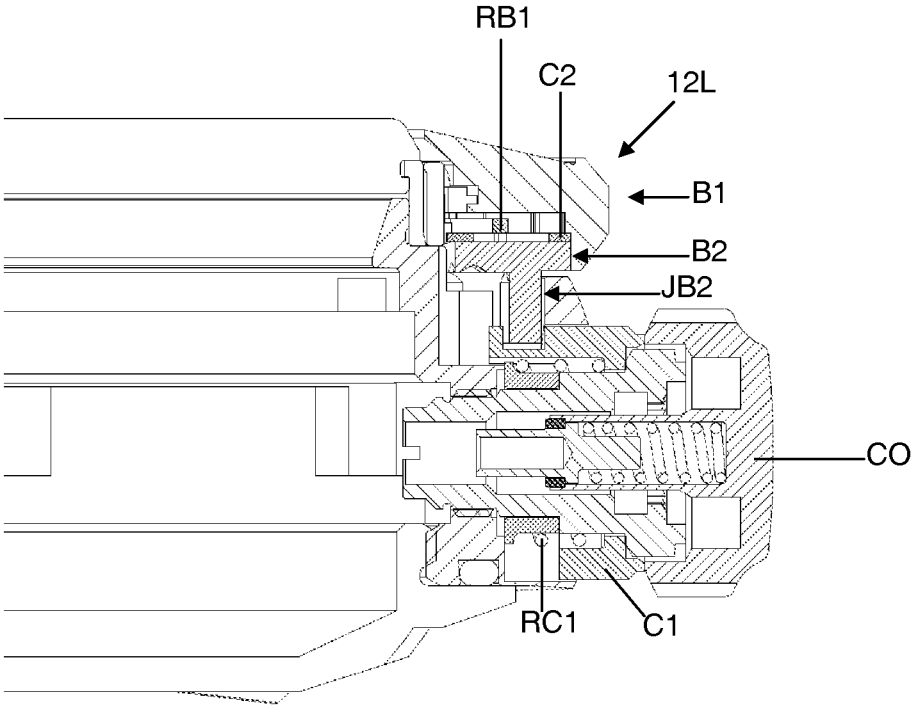
Figure 16:
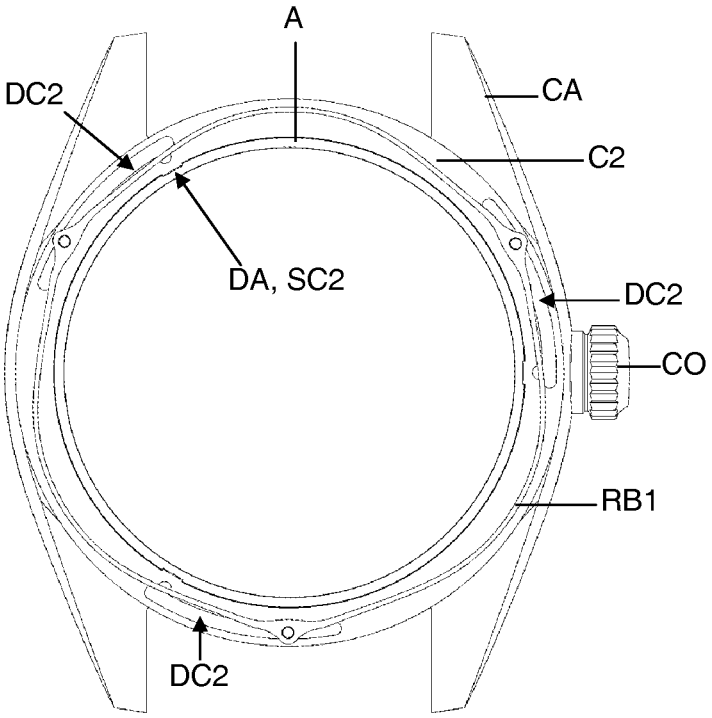
Figure 17:
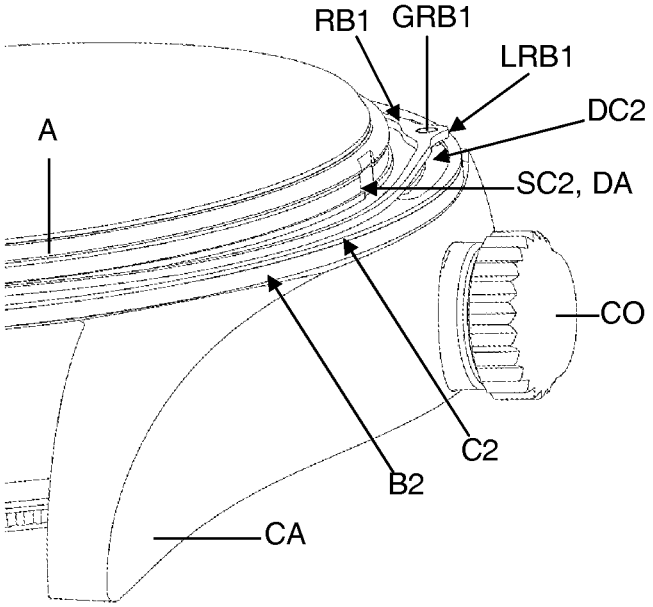
Figure 18:
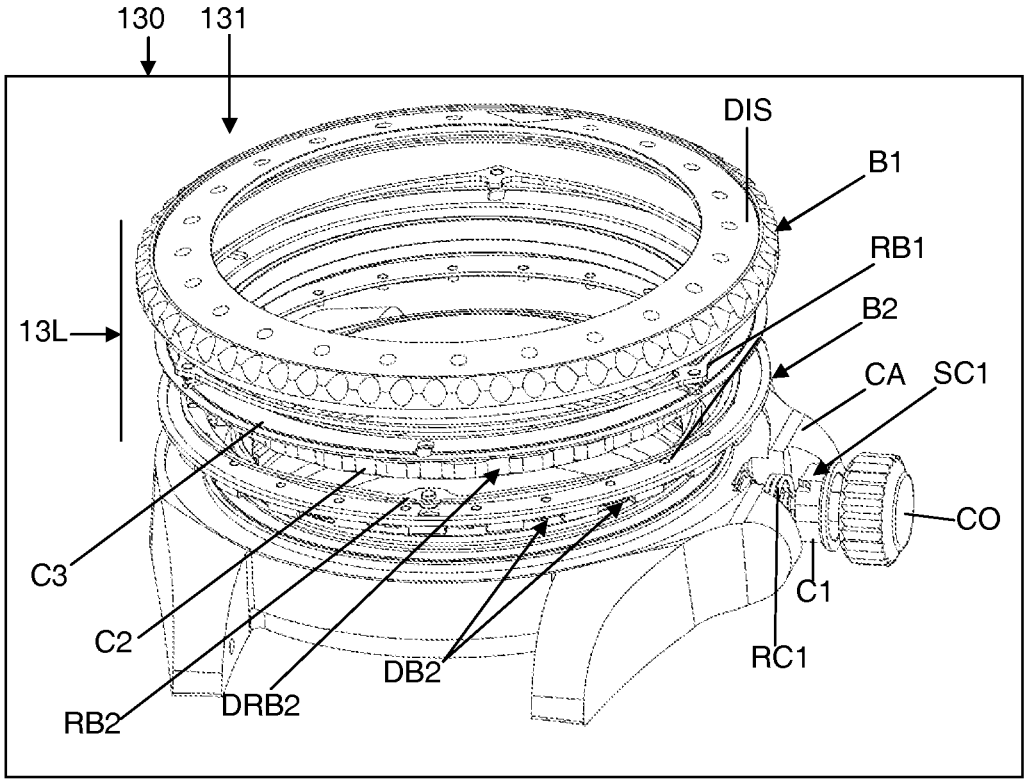
FIGS. 18 to 22 are views of a third alternative form of the first embodiment of a rotating bezel according to the invention.

The unscrewing of the crown CO causes the ring B2 to be freed so as to allow it to rotate and thus be driven in rotation under the effect of a movement of the ring B1 and of the spring RB1 as illustrated in FIGS. 15 to 17. Once the ring B2 has been made to rotate, the movement of the trigonal spring RB1 is canceled via a washer C2 secured to the case middle CA, the geometries of the cutouts DC2 of which block the radial movement of the pins GRB1 of this spring. Thus, the rings B1 and B2 are perfectly secured to one another in terms of rotation.

In this alternative form of embodiment, the washer C2 is secured and indexed to the case middle via projections SC2 which become inserted in cutouts DA formed at the periphery of a band A which is driven onto the case middle CA.

Figure 11:
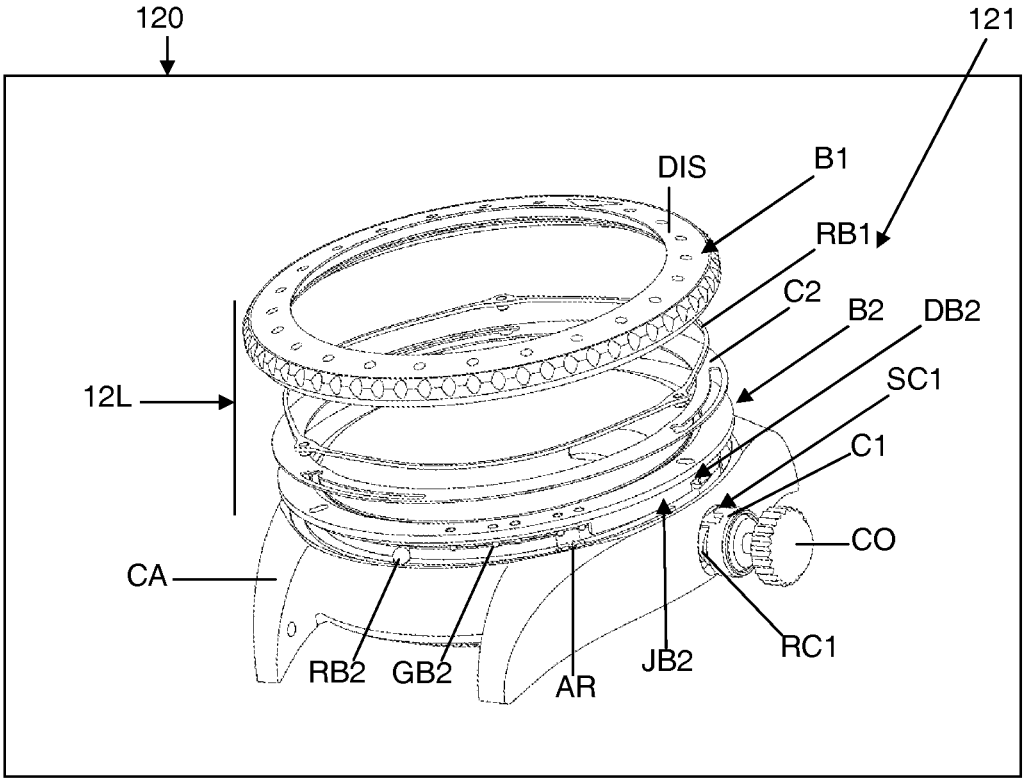
FIGS. 11 to 17 are views of a second alternative form of the first embodiment of a rotating bezel according to the invention.

As in the first alternative form of embodiment, the watch case comprises a second notching element for the notching of the ring B2 relative to the case middle. This second notching element comprises spring-loaded balls RB2 collaborating with cutouts DRB2 of the ring B2 as illustrated in FIG. 11. Thus, when the crown CO is unscrewed, the bezel 12L is notched over N notches defined by the springs RB2 and the cutouts DRB2. This number N may or may not be equal to the number n of notches defined by the spring RB1 and the toothset DRB1.

As in the first alternative form of embodiment, the rotating bezel device comprises a second element for connection between the ring B2 and a timepiece mechanism. This second connecting element comprises pins GB2 provided on the ring B2 which are capable of engaging with a shaft pivoted in the case middle CA so that the bezel can for example constitute a member for selecting or a member for adjusting a time indication or an indication derived from the time. The angular arc traveled by the bezel 12L is here strictly less than 360°, or even less than 180° when the crown CO is unscrewed. This angular range is notably delimited by the number, distribution and angular extent of the cutouts DC2 of the washer C2. The annular skirt JB2 is also formed at the periphery of the ring B2 so that the screwing-down of the crown can be performed only when the cutout DB2 of the ring B2 is situated facing the cam C1.

It will be noted that in this second alternative form of the first embodiment, the bezel device comprises a third mechanical-connection element having a first configuration, notably a first position, that allows the case middle and the second rotary ring B2 to be kinematically connected and a second configuration, notably a second position, that allows the rotational movement of the second rotary ring B2 relative to the case middle to be left free. The third mechanical-connection element is, in its first configuration, notably in its first position, able to secure the case middle and the second rotary ring together with lesser play, i.e. to immobilize the second ring on the case middle. The third mechanical-connection element comprises the shuttle C1.

A third alternative form of the first embodiment of a timepiece 130 according to the invention is described hereinafter with reference to FIGS. 18 to 22. The timepiece is notably a watch, particularly a wristwatch. The timepiece comprises a watch case 131 containing a timepiece movement 133 including one or more timepiece mechanisms 132.

The watch case comprises a case middle CA, a case back FD, a crystal GL and a rotating bezel device 13L.

The rotating bezel or rotary bezel device 13L comprises a first rotary ring B1, a second rotary ring B2 and a first mechanical-connection element C1, RB1, LRB1, SRB1, C2, DC2 allowing the first rotary ring and the second rotary ring to be kinematically connected.

In this third alternative form of the first embodiment, the ring B2 is capable of rotating over more than 360°. A spring RB2, notably a trigonal spring RB2, is secured in terms of rotation to the ring B2 through the interposition of pins GRB2 which are designed to be able to move in oblong cutouts DGRB2 of the ring B2.

A washer C2, driven directly onto the case middle CA, has, on the one hand, a toothset DRB2 which is designed to collaborate with the lobes LRB2 of the trigonal spring RB2 and has, on the other hand, means DC2 which are designed to cancel the movement of a trigonal spring RB1, similar to that of the second alternative form, when the ring B2 is driven in rotation. In the specific alternative form of embodiment illustrated in FIGS. 18 to 22, the teeth of the toothset DRB2 and the means DC2 coincide. Alternatively, the periphery, notably the exterior periphery, of the washer C2 could be notched on two levels so that the toothset DRB2 is formed on a first level and the means DC2 on a second level, or vice versa.

Advantageously, a ring C3, secured in terms of rotation to the ring B2 through the interposition of the spring RB2, notably of the pins LRB2 which are designed to be able to move in oblong cutouts DGRB2' of the washer C3, is provided so as to allow adequate assembly and functionality of the springs RB1 and RB2.

Figure 19:
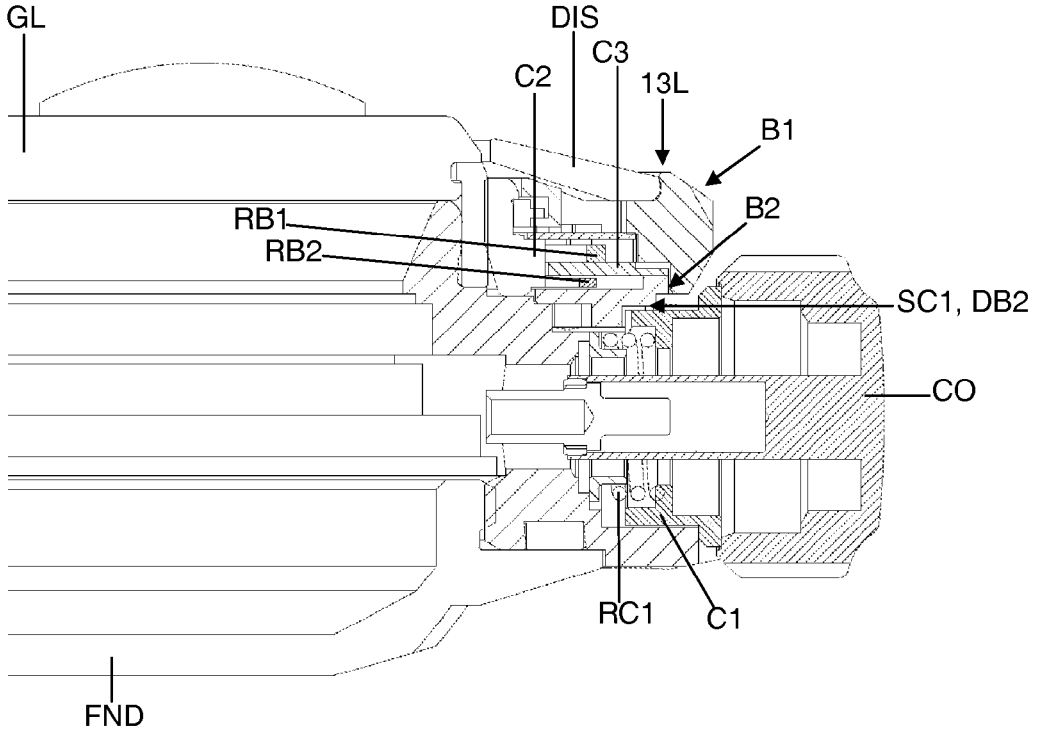
Figure 20:
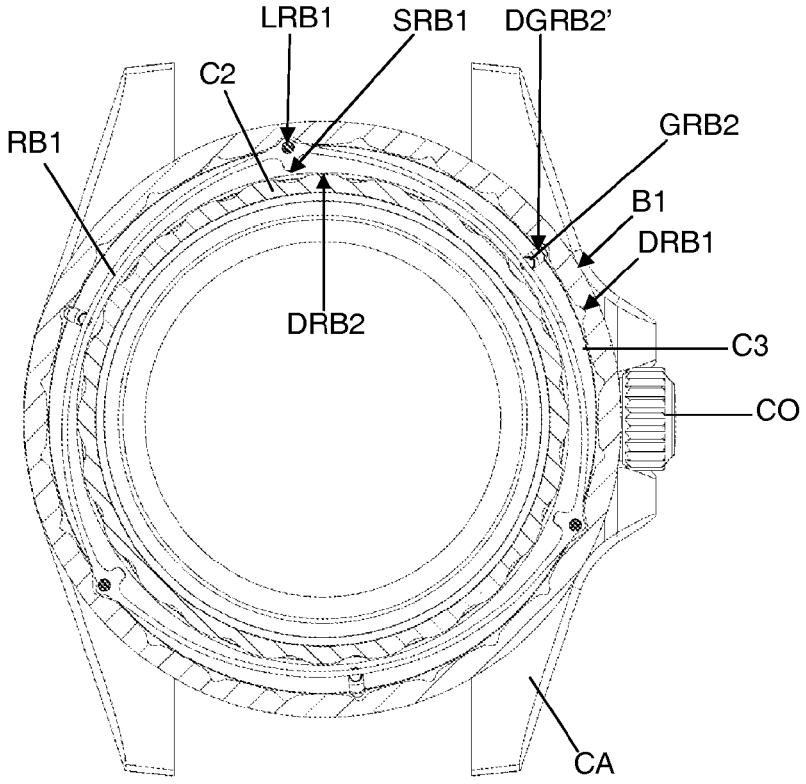

When the crown CO is screwed down as illustrated in FIG. 19, the ring B1 is capable of being driven in rotation relative to the ring B2 which is secured to the case middle via a cam C1 similar to that of the second alternative form. In this configuration, projections SRB1 formed on the lobes LRB1 of the spring RB1 may move within the N recesses of the toothset DRB2 which is configured for that purpose.

N corresponds to the number of notches defined by the spring RB2 and the toothset DRB2. N is preferably a multiple or a factor of n, where n is the number of notches defined by the spring RB1 and the toothset DRB1.

In the specific alternative form of embodiment illustrated in FIGS. 18 to 22, the toothsets DRB1 and DRB2 have the same number of teeth. The toothset DRB1, designed to collaborate with the spring RB1, is made up of 24 teeth so as to indicate and adjust a first time indication which is displayed on a 24-hour graduation affixed to the disk DIS of the bezel L and the toothset DRB2, designed to collaborate with the spring RB2, is made up of 24 notches so as to adjust for example a second time indication which is derived from the first piece of time information. For that purpose, as in the preceding alternative forms, the ring B2 bears pins GB2 which are able to actuate a shaft AR, pivoted in the case middle CA, in mesh with a mechanism 132 of the movement 133, notably a runner for adjusting the second piece of time information.

The unscrewing of the crown CO causes the ring B2 to be freed under the effect of the cam C1 and of the spring RC1, so as to allow it to be driven in rotation by the bezel 13L. Once the latter is driven in rotation, the movement of the projections SRB1 and of the lobes LRB1 of the trigonal spring RB1 may be respectively canceled by the teeth, particularly the crests of the teeth, of the toothset DRB2 and by the teeth of the toothset DRB1, over an angular amplitude substantially equal to 360°/N. Thus, when the crown CO is unscrewed, and the user operates the bezel, the ring B1 driving the ring B2 in rotation via the action of the spring RB1, the rings B1 and B2 find themselves joined together in terms of rotation or immobilized relative to one another.

In this alternative form, the first mechanical-connection element comprises the cam C1, the washer C2 and the toothset DRB2, the spring RB1 and the toothset DRB1.

In this alternative form the second mechanical-connection element comprises the pins GB2 and possibly the shaft AR.

In this alternative form, the third mechanical-connection element comprises the cam C1, notably the projection SC1 and the ring B2, notably the openings DB2 in the ring B2.

In this alternative form, the first notching element comprises the spring RB1 and the toothset DRB1.

In this alternative form, the second notching element comprises the leaves of the spring RB2 and the toothset DRB2.

Alternatively, the first mechanical-connection element could comprise only the cam C1, the spring RB1 and the toothset DRB1, in the instance in which the torque produced by the spring RB1 is appreciably greater than the torque produced by the torque RB2. In this alternative form of embodiment, the spring RB1 could thus be devoid of the projections SRB1 which are formed on each of the lobes LRB1 of the spring RB1, the latter being secured to the ring B1 only via the lobes LRB1 which, when the crown CO is unscrewed, each fall between two teeth of the toothset DRB1 of the ring B1.

In each of the alternative forms of embodiment described, the rings B1, B2 are respectively notched by springs RB1, RB2 and toothsets DRB1, DRB2. Nevertheless, it is entirely possible to use a bezel at least one ring of which has no notch.

In the second and third alternative forms of embodiment, geometries DC2 of the washer C2 are designed to cancel the notching between the spring RB1 and the toothset DRB1 of the ring B1. The washer C2 is optional in the event that the greater torque generated by the spring RB1 and the toothset DRB1 is appreciably greater than the torque produced by the spring RB2 and the toothset DRB2 and when the ring B2 is capable of rotating through more than 360°.

In each of the alternative forms of embodiment, the rings B1 and B2 can be driven in rotation in both directions of rotation. Of course, the springs RB1, RB2 and the toothsets DRB1, DRB2 can be configured in such a way that the ring B1 and/or the ring B2 move in just one direction of rotation.

In the second embodiment of the timepiece the rings B1 and B2 are toothed. The rings can be kinematically connected by at least one intermediate wheel RBC1. The intermediate wheel may be pivoted on a lever or on an auxiliary ring BC1. The lever or the auxiliary ring is actuated directly or indirectly via a cam C1 and/or a spring RC1. As in the first embodiment, the cam C1 is operated by a control member CO, notably a crown.

A first alternative form of the second embodiment of a timepiece 210 according to the invention is described hereinafter with reference to FIGS. 23 to 30. The timepiece is notably a watch, particularly a wristwatch. The timepiece comprises a watch case 211 containing a timepiece movement 213 including one or more timepiece mechanisms 212.

The watch case comprises a case middle CA, a case back FD, a crystal GL and a rotating bezel device 21L.

The rotating bezel or rotary bezel device 21L comprises a first rotary ring B1, a second rotary ring B2 and a first mechanical-connection element BC1, RBC1 allowing the first rotary ring and the second rotary ring to be connected kinematically.

The first mechanical-connection element comprises a lever BC1. The pivot pin PBC1 for the lever is arranged on an annular seat SA of the case middle CA as illustrated in FIG. 21.

The spacing 360°/n for the angular indexing of the bezel is the same here regardless of the position of the control member. It is defined by a single solitary trigonal spring RB1 borne by the ring B1. This spring is assembled on the ring B1 in the same way as that of the first alternative form of the first embodiment.

Figure 21:
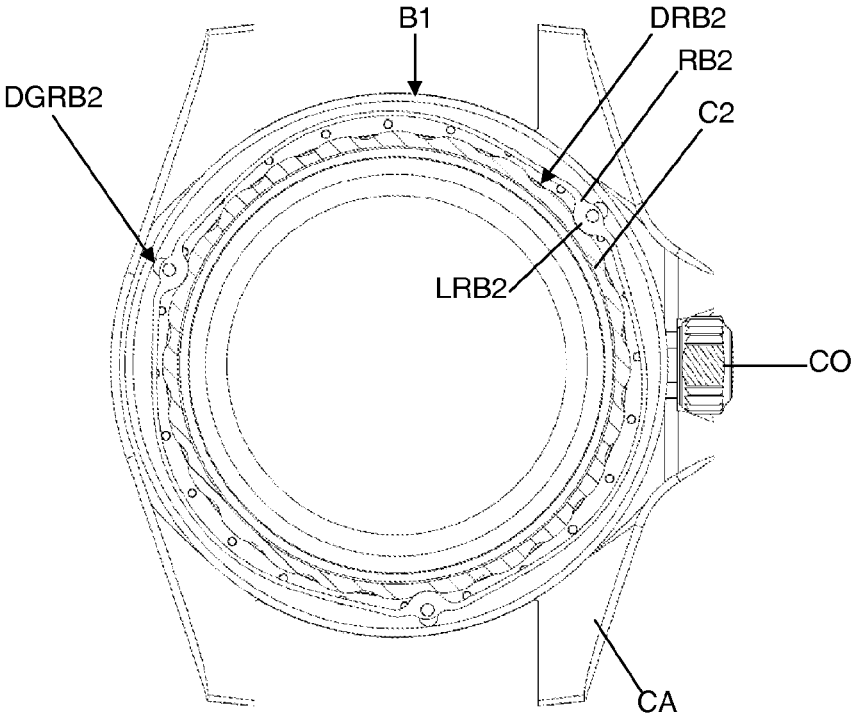
Figure 22:
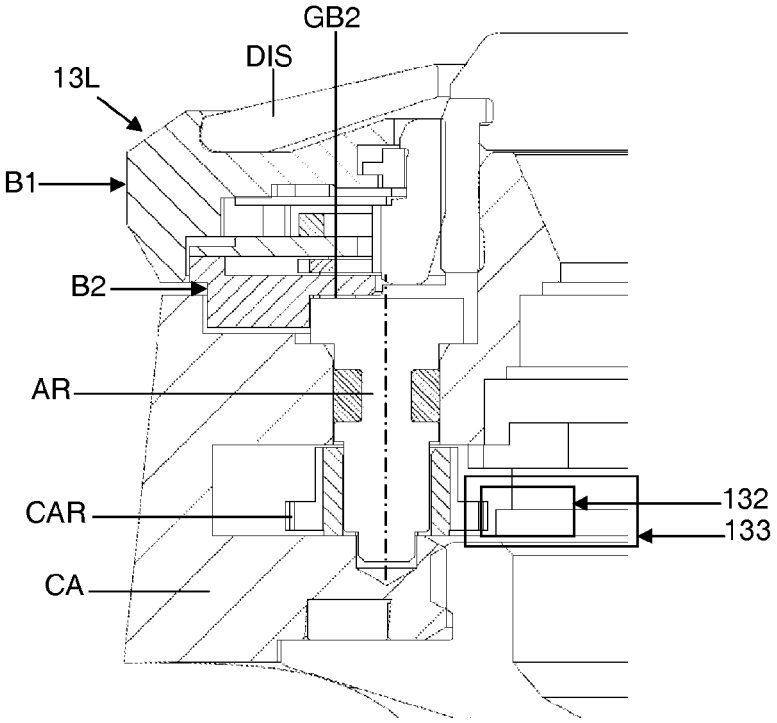

When the crown CO is screwed down as illustrated in FIGS. 19 to 22, it keeps the lever BC1, via the cam C1, in a position such that the intermediate wheel RBC1 is out of reach of the toothsets DB1', DB2' of the respective rings B1, B2 as illustrated in FIG. 21. In this configuration, the ring B1 is held by the spring RB1 the lobes LRB1 of which are designed to collaborate with a toothset DRB1 borne by a band A secured to the case middle CA. The ring B2 itself is kept in position by friction by the spring washer RC1 and/or by a resistive torque coming from a shaft AR pivoted in the case middle.

Figure 23:
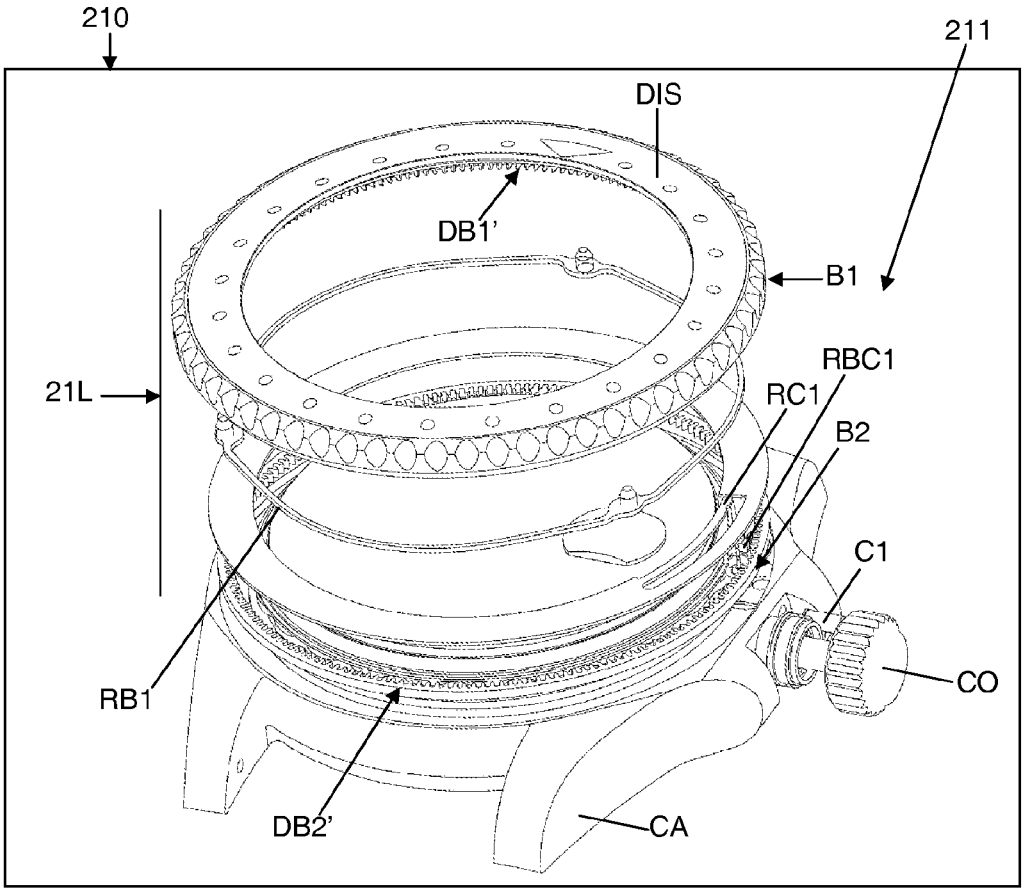
FIGS. 23 to 30 are views of a first alternative form of a second embodiment of a rotating bezel according to the invention.
Figure 24:
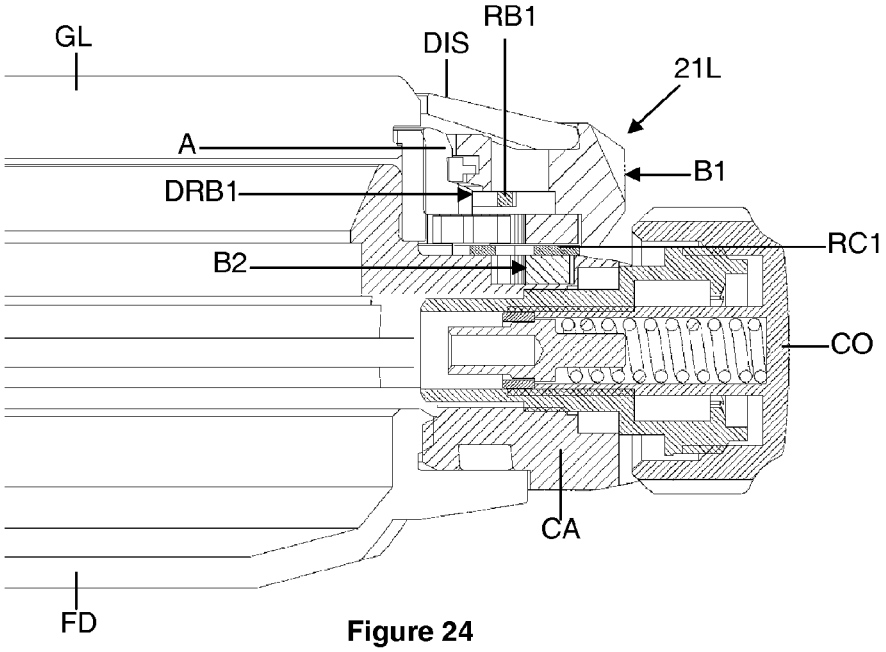
Figure 25:
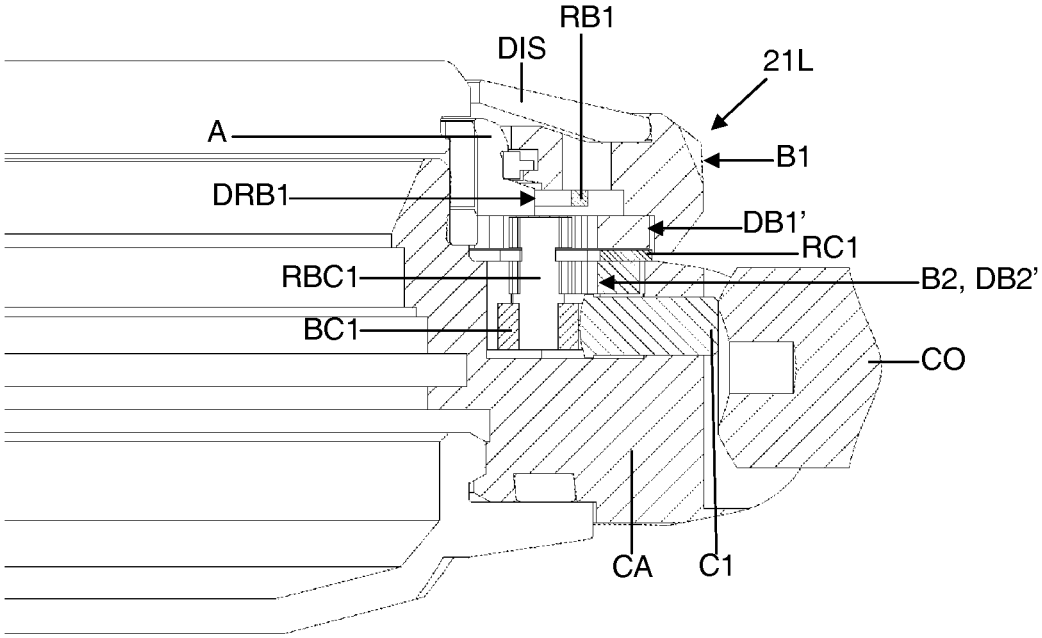
Figure 26:
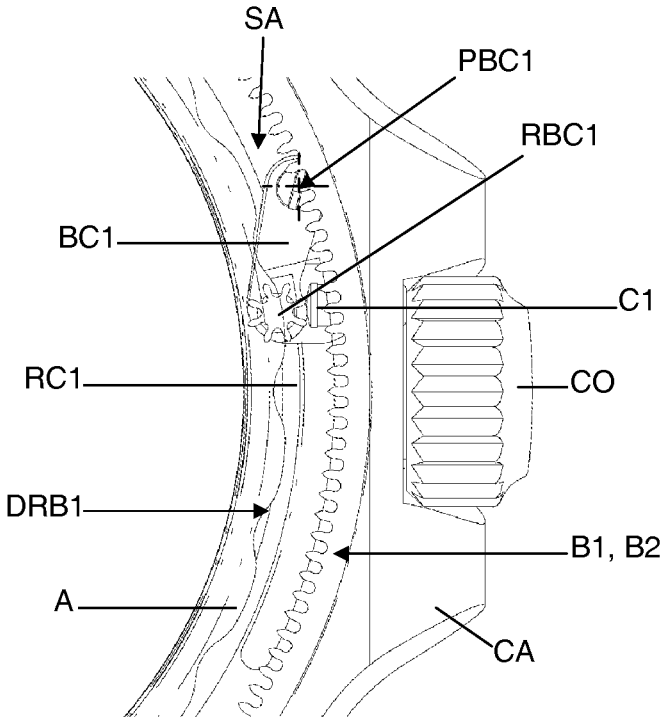
Figure 27:
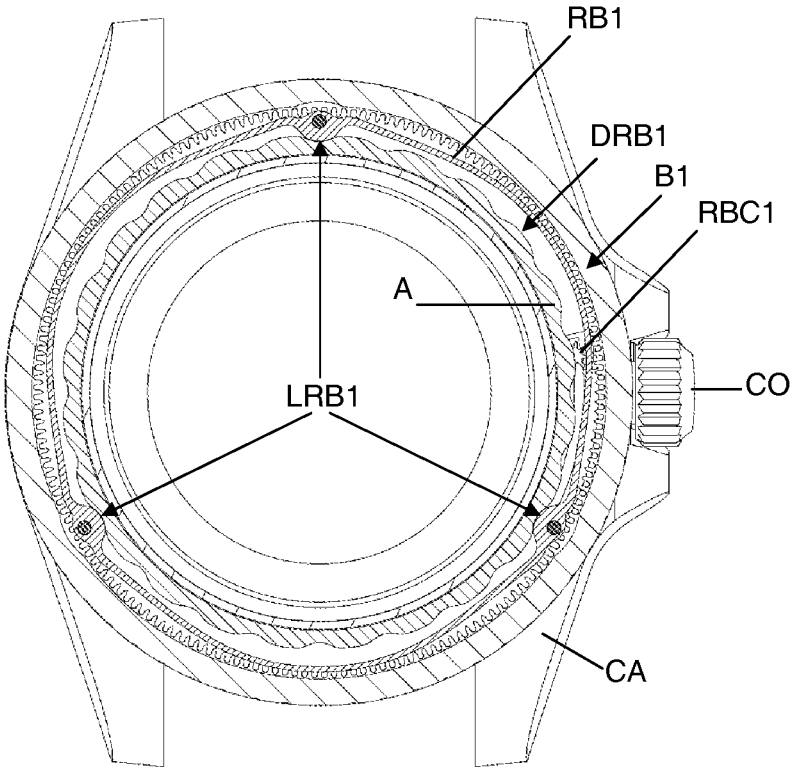
Figure 28:
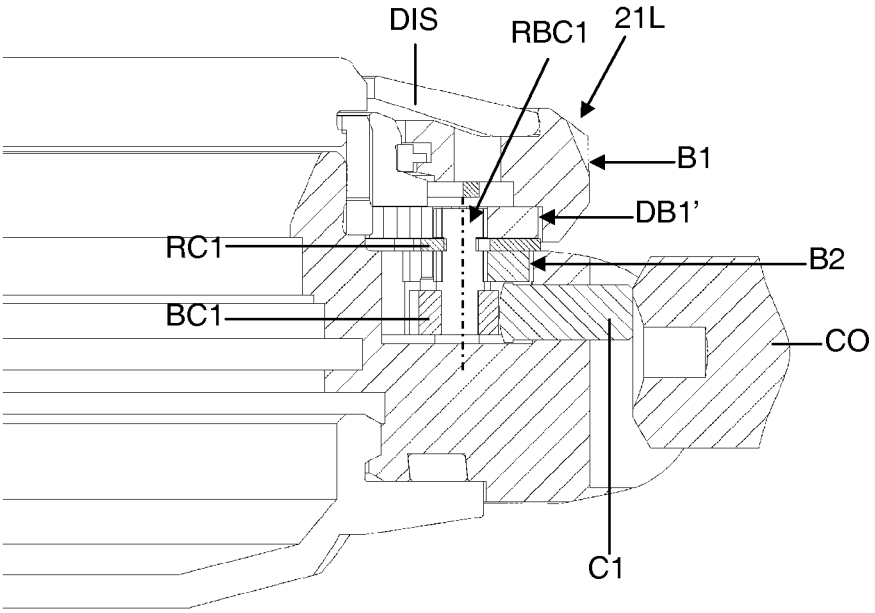
Figure 29:
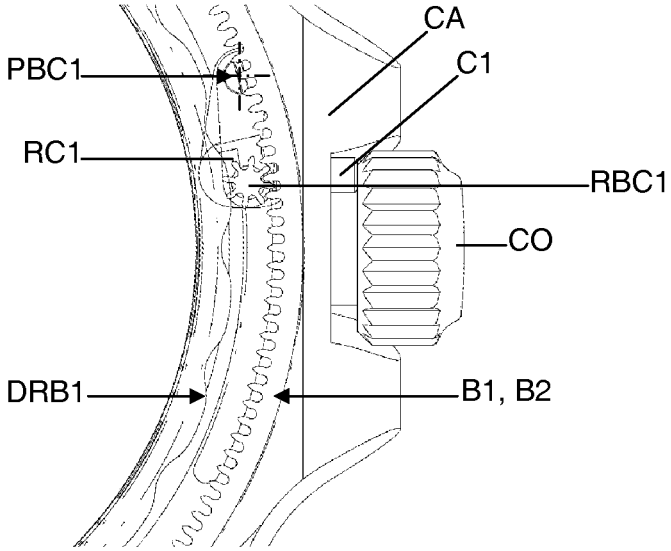
Figure 30:
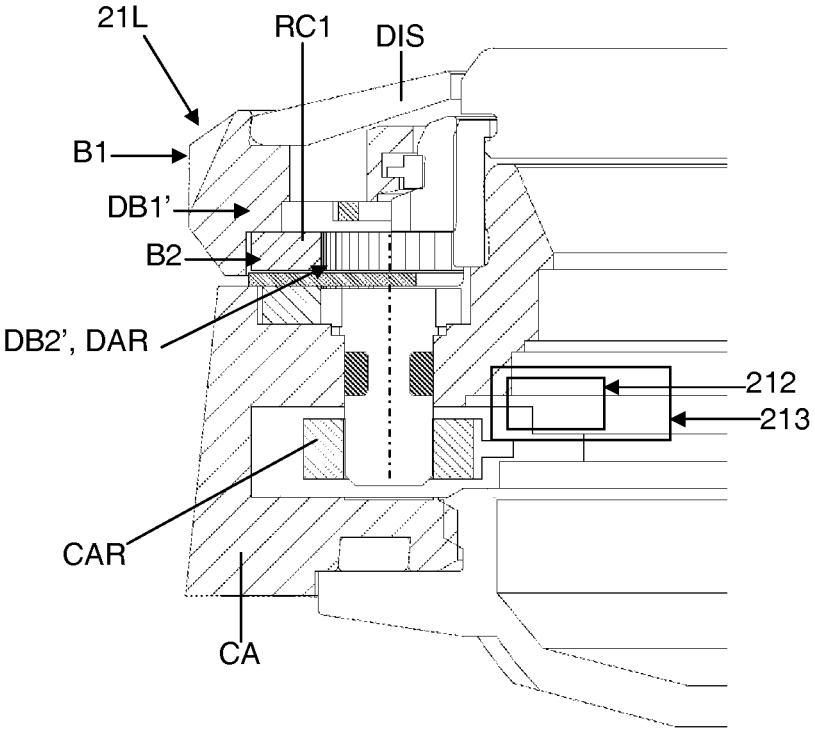

Thus, when the crown CO is screwed down, the ring B1 can turn relative to the ring B2 by n steps defined by the spring RB1 and the toothset DRB1. The unscrewing of the crown CO causes the lever BC1 to rotate under the effect of a spring, notably the leaf spring of the washer RC1, and thus causes the rings B1 and B2 to engage through the interposition of the intermediate wheel RBC1, as illustrated in FIGS. 23 and 24. In this configuration, the rings B1 and B2 can turn relative to the case middle CA by n steps defined by the spring RB1 and the toothset DRB1. In this construction, the toothset DB2' of the ring B2 is in mesh with the toothset DAR of a shaft AR pivoted in the case middle. As in the alternative forms described hereinabove, this shaft may be in mesh with the mechanism 212, notably a member for selecting or adjusting the movement.

In this alternative form, the spring RC1 actuates the lever BC1 via the intermediate wheel RBC1 as illustrated in FIG. 23.

For preference, the spring RC1 is dimensioned in such a way that the engagement device comprising the cam C1, the lever BC1 and the spring RC1 constitutes a limiter of the torque transmitted between the rings B1 and B2. Such a device may be of particular utility when the shaft AR is capable of transmitting torques appreciably higher than those produced by the spring RB1 and the toothset DRB1.

Such a construction also has the advantage of requiring a minimum of components to implement a bezel 21L capable of performing two separate functions.

In this alternative form, the first mechanical-connection element comprises the lever BC1 and the intermediate wheel RBC1.

In this alternative form, the second mechanical-connection element comprises the toothsets DB2' and DAR and possibly the shaft AR.

In this alternative form, the third mechanical-connection element preferably comprises the spring washer RC1.

In this alternative form, the first notching element comprises the spring RB1 and the toothset DRB1.

In this alternative form, the second notching element comprises the spring RB1 and the toothset DRB1.

A second alternative form, not depicted, of the second embodiment of a timepiece according to the invention is described hereinafter. The timepiece is notably a watch, particularly a wristwatch. The timepiece comprises a watch case containing a timepiece movement including one or more timepiece mechanisms.

The watch case comprises a case middle, a case back, a crystal and a rotating bezel device.

The rotating bezel or rotary bezel device comprises a first rotary ring, a second rotary ring and a first mechanical-connection element allowing the first rotary ring and the second rotary ring to be kinematically connected.

In the second alternative form, the first mechanical-connection element may comprise an auxiliary ring coaxial with the first and second rings and configured to constitute the planet carrier for at least one planetary gear which is designed to kinematically connect the first and second rings. Thus, the bezel here includes an epicyclic gearset designed to kinematically connect the first and second rings. In this second alternative form, the auxiliary ring is preferably secured in terms of rotation to a third ring onto which a disk indicating time information is driven. In this alternative form of embodiment, the disk thus has the particular feature of being able to be uncoupled from the first ring when the bezel is manipulated in the crown-unscrewed position.

Unlike in the first alternative form of embodiment, the bezel spacing may vary according to the position of the crown through the use of separate first and second springs.

When the crown is screwed down, the first ring is capable of being driven in rotation relative to the second ring which is secured to the case middle via a cam or shuttle arranged coaxial with the crown, similar to that of the second and third alternative forms of the first embodiment. For that, the cam is housed in one of the N cutouts made at the external periphery of the second ring. N may be equal to the number of notches defined by the springs and the cutouts of the second ring, which are preferably similar to those of the first and second alternative forms of the first embodiment. The angular spacing of the first ring is, for its part, preferably defined by a trigonal spring which rotates as one with the rings BC1 and BDIS, through the intermediary of pins which may be provided for the pivoting of the planetary gear or gears and advantageously for securing the auxiliary ring and the third ring together. Lobes of the spring may be designed to collaborate with a toothset attached to a ring secured to the case middle. Thus, when the crown is screwed down, the bezel is notched over n notches defined by the first spring and the toothset. By way of example, the toothset may be made up of 24 teeth so as to indicate and adjust a time which is displayed on a 24-hour graduation affixed to the disk of the bezel 22L.

When the crown is unscrewed, the cam is designed to engage in one of the n cutouts made in the external periphery of the auxiliary ring, thus blocking in terms of rotation the auxiliary ring and the third ring. The disk is therefore blocked in the angular position it occupied before the crown was unscrewed. The second ring is capable of being driven in rotation under the effect of the rotation of the first ring through the agency of the intermediate wheel or wheels. In this configuration, the notching performed by the first trigonal spring is canceled and gives way to the notching defined by the second spring and the cutouts of the second ring. The bezel, more particularly the first ring, can turn through z_B1/z_B2×N notches where z_B1 and z_B2 are respectively the number of teeth of the first and second rings.

As in the previous alternative forms of embodiment, the second ring, through the interposition of its pins, can come into mesh with a shaft pivoted in the case middle. This shaft, via a cam, can actuate a mechanism, notably a cam that selects movement mechanisms, or else a runner for correcting a time indication or an indication derived from the time.

In this alternative form, the first mechanical-connection element comprises the auxiliary ring and the planetary gears.

In this alternative form, the second mechanical-connection element comprises the pins and possibly the shaft.

In this alternative form, the third mechanical-connection element comprises the cam and the cutouts of the auxiliary ring.

In this alternative form, a fourth mechanical-connection element allows the auxiliary ring and the case middle to be secured together with lesser play. This element comprises the cam and the cutouts of the auxiliary ring.

In this alternative form, the first notching element comprises the first spring and the toothset.

In this alternative form, the second notching element comprises the second springs, notably the spring-loaded balls, and the toothset.

The second embodiment in particular allows the first and second rings to rotate through more than 360°.

In the various alternative forms described, the rings B1 and B2 can be driven in rotation in both direction of rotation. Of course, it is possible to configure the springs RB1, RB2 and the toothsets DRB1, DRB2 such that the ring B1 and/or the ring B2 move in just one direction of rotation.

Throughout this document "rotary ring" preferably means a ring capable of turning relative to another element, particularly another ring or a case middle. For preference, the rotary ring is capable of turning about its axis with respect to the other ring. For preference, the axes of the two rings are coincident. For preference, the rotary ring is capable of turning about its axis with respect to the other ring. For preference, the axes of the two rings are coincident. For preference, the axis of the ring and that of the case middle are coincident.

Throughout this document, "mechanical-connection element allowing the first rotary ring and the second rotary ring to be kinematically connected" preferably means an element which, according to its configuration, allows:

the first and second rings to be connected or secured, notably fixed, in terms of rotation or the first and second rings to be left independent.

Thus, in a first configuration, by action on the rotating bezel, the user can drive the first ring in rotation with respect to the case middle while the second ring remains fixed with respect to the case middle. In that way, a first timepiece function can be performed. Thus, in a second configuration, by action on the rotating bezel, the user can drive the first ring and the second ring in rotation with respect to the case middle. In that way, a second timepiece function may be performed.

The invention claimed is:

1. A rotary bezel device for a timepiece, the device comprising:

a first rotary ring, a second rotary ring and a first mechanical-connection element allowing the first rotary ring and the second rotary ring to be kinematically connected, wherein in an assembled state of the device, the device is adapted to position the first mechanical-connection element selectively in (i) a first configuration in which a rotational movement of the first rotary ring and a rotational movement of the second rotary ring are independent of one another, and (ii) a second configuration in which the first rotary ring and the second rotary ring are kinematically connected in rotation.

2. The device as claimed in claim 1, wherein the first mechanical-connection element is arranged so as to secure the first rotary ring and the second rotary ring together.

3. The device as claimed in claim 2, wherein, in the second configuration, the first rotary ring and the second rotary ring are substantially fixed in rotation relative to each other.

4. The device as claimed in claim 1, wherein the first rotary ring comprises marks or indexes for indicating time or indicating a derivative of the time.

5. The device as claimed in claim 1, wherein the first rotary ring is arranged in such a way as to at least one of (i) axially and/or radially cover the second rotary ring, and (ii) hide the second rotary ring.

6. The device as claimed in claim 1, wherein the second rotary ring comprises a second mechanical-connection element allowing the second rotary ring to be connected kinematically to a mechanism of a timepiece movement.

7. The device as claimed in claim 1, wherein the device comprises a first notching element allowing to carry out a notching between the first and second rotary rings.

8. The device as claimed in claim 1, wherein the device comprises a spring mounted on the first rotary ring, respectively on the second rotary ring, and collaborating by contact with a shaping produced on the second rotary ring, or respectively on the first rotary ring.

9. The device as claimed in claim 1, wherein the second rotary ring comprises a second notching element allowing to carry out a notching between the second rotary ring and a watch case middle or a watch case.

10. The device as claimed in claim 1, wherein the first mechanical-connection element comprises a cam mounted to rotate on the second rotary ring and designed to collaborate as an obstacle with a shaping made in a watch case middle.

11. The device as claimed in claim 1, wherein the first mechanical-connection element comprises a washer provided with cutouts and/or a first notching element.

12. The device as claimed in claim 1, wherein the first mechanical-connection element comprises at least one intermediate wheel able to engage with at least one of the first and second rotary rings.

13. A watch case comprising a device as claimed in claim 1.

14. The watch case as claimed in claim 13, wherein the case comprises a third mechanical-connection element that allows the second rotary ring and the case middle to be secured together.

15. The watch case as claimed in claim 14, wherein, in the first configuration, the second rotary ring is substantially fixed in rotation relative to the middle.

16. The watch case as claimed in claim 14, wherein (i) in the first configuration, the rotational movement of the second rotary ring is substantially fixed relative to the case middle, and (ii) in the second configuration, the rotational movement of the secondary rotary ring is independent of the case middle.

17. The watch case as claimed in claim 13, wherein the case comprises a fourth mechanical-connection element that allows an auxiliary ring and the case middle to be secured together.

18. The watch case as claimed in claim 17, wherein the third mechanical-connection element comprises a cam mounted for translational movement relative to the case middle and designed to collaborate as an obstacle with a shaping made on the second rotary ring.

19. The watch case as claimed in claim 17, wherein, in the second configuration, the auxiliary ring is substantially fixed in rotation relative to the middle.

20. The watch case as claimed in claim 19, wherein the auxiliary ring is configured as a planet carrier for at least one planetary gear designed to kinematically connect the first rotary ring and the second rotary ring.

21. The watch case as claimed in claim 13, wherein the watch case comprises a control member and wherein at least one of the first mechanical-connection element, a third mechanical-connection element and a fourth mechanical-connection element is designed to collaborate with the control member, a configuration of the control member determining the configuration of at least one of the first mechanical-connection element, the third mechanical-connection element and the fourth mechanical-connection element.

22. A watch case comprising:

a device as claimed in claim 1 and a case middle, wherein the first mechanical connection element comprises a cam mounted to rotate on the second rotary ring, respectively on the case middle, and designed to collaborate as an obstacle with a shaping made in the case middle, respectively, on the second rotary ring.

23. A watch case comprising:

a device as claimed in claim 1 and a case middle, wherein the first mechanical-connection element comprises a cam mounted for translational movement relative to the case middle and designed to collaborate as an obstacle with a shaping made on the second rotary ring.

24. A watch case comprising:

a device as claimed in claim 1 and a case middle, wherein the first mechanical-connection element comprises a washer provided with cutouts.

25. A timepiece comprising a device as claimed in claim 1.

* * * * *